US006876251B2

(12) United States Patent
Watanabe

(10) Patent No.: US 6,876,251 B2
(45) Date of Patent: Apr. 5, 2005

(54) REFERENCE VOLTAGE SOURCE CIRCUIT OPERATING WITH LOW VOLTAGE

(75) Inventor: Hirofumi Watanabe, Hyogo (JP)

(73) Assignee: Ricoh Company, Ltd. (JP)

( * ) Notice: Subject to any disclaimer, the term of this patent is extended or adjusted under 35 U.S.C. 154(b) by 0 days.

(21) Appl. No.: 10/388,404

(22) Filed: Mar. 17, 2003

(65) Prior Publication Data

US 2003/0197552 A1 Oct. 23, 2003

(30) Foreign Application Priority Data

Mar. 20, 2002 (JP) ..... 2002-077912

(51) Int. Cl.[7] ..... G05F 1/10; G05F 3/02
(52) U.S. Cl. ..... 327/541; 323/315
(58) Field of Search ..... 327/538, 540, 327/541, 543, 539; 323/312, 315, 313, 316

(56) References Cited

U.S. PATENT DOCUMENTS

| | | | | |
|---|---|---|---|---|
| 5,426,616 A | * | 6/1995 | Kajigaya et al. | 365/226 |
| 5,656,841 A | | 8/1997 | Watanabe et al. | 256/65.03 |
| 5,825,673 A | | 10/1998 | Watanabe | 703/14 |
| 5,825,695 A | * | 10/1998 | Hamaguchi | 365/189.09 |
| 6,075,404 A | | 6/2000 | Shindoh et al. | 327/537 |
| 6,271,730 B1 | | 8/2001 | Abe et al. | 331/34 |
| 6,437,550 B2 | | 8/2002 | Andoh et al. | 323/313 |
| 6,552,603 B2 | * | 4/2003 | Ueda | 327/541 |

FOREIGN PATENT DOCUMENTS

JP 4-65546 10/1992

JP 2001-284464 10/2001

OTHER PUBLICATIONS

"A New NMOS Temperature–Stable Voltage Reference", by Robert A. Blauschild et al. IEEE Journal of Solid–State Circuits. vol. SC–13, No. 6, Dec. 1978, pp. 767–774.

"CMOS Analog Integrated Circuits Based on Weak Inversion Operation", by Eric Vittoz et al. IEEE Journal of Solid–State Circuits, vol. SC–12, No. 3, Jun. 1977, pp. 224–231.

"MOS Voltage Reference Based on Polysilicon Gate Work Function Difference", by Henri J. Oguey et al. IEEE Journal of Solid–State Circuits, vol. SC–15, No. 3, Jun. 1980, pp. 264–269.

* cited by examiner

*Primary Examiner*—Quan Tra
(74) *Attorney, Agent, or Firm*—Dickstein Shapiro Morin & Oshinsky LLP

(57) ABSTRACT

A reference voltage source circuit, which can generate a sufficiently low reference voltage and which can stably operate at temperatures above 80 degrees Celsius, is provided. The circuit comprises two MOS transistors with gates of equal temperature characteristics of threshold voltage but of different impurity concentrations. The difference of voltages between the gates and the sources of the two MOS transistors is obtained as the reference voltage. When the gates of two transistors are connected together, the source of one of the transistors is connected to the ground, the difference of voltage between the gate and the source of two transistors becomes the source voltage of the other one of the transistors, and this source voltage of the other one of the transistors becomes the reference voltage.

20 Claims, 10 Drawing Sheets

REFERENCE VOLTAGE SOURCE CIRCUIT OPERATING WITH LOW VOLTAGE

BACKGROUND OF THE INVENTION

1. Field of the Invention

The present invention generally relates to a reference voltage source circuit used in analog circuits, etc., and in particular to a reference voltage source circuit that is able to operate with a low voltage.

2. Description of the Related Art

According to the conventional reference voltage source circuits employing MOS transistors such as described in, for example, Japanese Patent Publication No. 04-65546 (citation 1), the difference between a threshold voltage of a depletion type transistor and a threshold voltage of an enhancement type transistor, both transistors formed by changing substrates or the channel doping concentration, is provided as a reference voltage.

As for the related art described in Japanese Laid-Open Patent Application No. 2001-284464 (citation 2), a voltage Proportional-To-Absolute-Temperature (PTAT) is provided as the reference voltage by using a weak inversion region of gates of MOS transistors instead of bipolar transistors. Using the weak inversion region of gates of MOS transistors means to make the transistor operate in the vicinity of the threshold voltage, which inverts the gate. Usually, transistors operate in a strong inversion region.

According to the citation 1, since conductivity and its temperature characteristics of the transistors with different substrates or different channel dopant concentrations vary, it is difficult to realize a reference voltage source circuit with a desired temperature characteristic. In addition, there is a disadvantage in that such transistors are susceptible to variation in the manufacturing process since the amount of channel dopant in transistors must be controlled individually.

In order to adjust the temperature characteristic of the conductivity, a separate current bias circuit is necessary as described in reference F (R. A. Blauschild et al, "A New NMOS Temperature—Stable Voltage Reference" IEEE Journal of Solid-State Circuits, Vol. SC-13, No. 6, pp. 767–773, December 1978) in the citation 2.

According to the related art described in the citation 2, the following disadvantages are present since a weak inversion region of gates is used.

a) In order to cause the weak inversion state in the gate of a MOS transistor, a minute electric current bias circuit is necessary. According to reference B (E. Vittoz and J. Fellrath, "CMOS Analog Integrated Circuits Based on Weak Inversion Operation" IEEE Journal of Solid-State Circuits, Vol. SC-12, No. 3, pp. 224–231, June 1997) cited in the citation 2, in order to keep the MOS transistor in the weak inversion region, the drain current must fulfill the following relation:

$$I \leqq ((n-1)/e^2) S \mu \mathrm{Cox} U_T^2$$

where n is a slope factor, S is ratio between effective channel width W and effective channel length L (Weff/Leff), $\mu$ is mobility of carriers in the channel, and Cox is capacitance of oxide film per unit area.

In particular, when the parameters are set as follows: n=1.7, S=1, $\mu$=750 $cm^2$/Vs, Cox=45 nF/$cm^2$, UT=26 mV as in reference E (U.S. Pat. No. 4,327,320, April 1982, "REFERENCE VOLTAGE SOURCE", Oguey) cited in the citation 2, the drain current at room temperature must be under 2 nA, which is extremely difficult to realize.

b) Further, in the case of operating the transistor with a minute drain current such as 2 nA as mentioned above, the operation of the transistor is susceptible to leakage current of the parasitic diode between drain and substrate and problems due to the parasitic diodes may occur. For example, in page 268 of reference D (Oguey et al., "MOS Voltage Reference Based on Polysilicon Gate Work Function Difference", IEEE Journal of Solid-State Circuits, Vol. SC-15, No. 3, June 1980) cited in the citation 2, it is mentioned that at temperatures above 80 degrees Celsius, deviations are generated due to the leakage current.

Therefore, according to the citation 2, as shown in FIG. 1 (corresponding to FIG. 22 in citation 2), a first voltage source circuit having negative temperature coefficients and comprises MOS transistors 101, 102 having semiconductor gates of a different conduction type, and a second voltage source circuit having positive temperature coefficients and comprises MOS transistors 103, 104 having semiconductor gates of the same conduction type but of different impurity concentrations, are combined so as to provide a reference voltage source circuit that can be dispensed with a minute current bias circuit by making use of a strong inversion region. The reference voltage source circuit uses MOS transistors that can operate stably at temperatures above 80 degrees Celsius. Accordingly, the reference voltage source circuit using MOS transistors having a desired temperature characteristic is realized.

However, according to the citation 2, the output voltage of the first voltage source circuit amounts to approximately 1 V as opposed to the output voltage of the second voltage source circuit that only ranges from several tens of mV to one hundred and tens of mV. In order to configure a reference voltage source circuit with a desired temperature characteristic, these two output voltages are summed at some proportion. Therefore, in the reference voltage source circuit shown in FIG. 1, more than 1 V power supply voltage (operating voltage) Vcc is necessary. When actually tested with a production prototype of the circuit, approximately 1.2 V was the lowest necessary operating voltage. This is because, as shown in FIG. 1, a source follower transistor M5, which needs a voltage of several mV to start operating, is provided between the power supply voltage (Vcc) terminal and the terminal V1 of the second voltage source circuit, which terminal V1 has the output voltage of approximately 1 V, and the sum of the operation starting voltage of the source follower transistor 5 and the output voltage of the terminal V1 becomes the lowest necessary power supply voltage Vcc.

In the meanwhile, along with the recent increase in the popularity of portable equipment, the requests for LSIs performing battery operations are increasingly varied. Especially, reducing the value of the operating voltage (power supply voltage) so as to drastically extend the service life of batteries is strongly requested for the systems driven by a single battery. The lowest necessary operating voltage of 1.2 V of the circuit in FIG. 1 is not a high voltage at all, however, the lowest necessary operating voltage Vcc lower than 0.9 V is requested. Inventions described in other than the citation 2 also cannot realize such a reference voltage source circuit operating with such low operating voltage.

SUMMARY OF THE INVENTION

Accordingly, it is an object of the present invention to provide a reference voltage source circuit employable in analog circuits, etc., which reference voltage source circuit can realize a stable operation even with a power supply (operating) voltage lower than 1 V.

Further, it is another object of the present invention to provide a reference voltage source circuit that can realize a stable operation at operating temperatures above 80 degrees Celsius and to provide a reference voltage source circuit with an accurately determined temperature characteristic.

In order to achieve the above-mentioned objects, as a first aspect of the present invention, a reference voltage source circuit, which comprises a plurality of MOS transistors, a part of which has gates of the same conduction type but of different impurity concentrations, is provided.

In the circuit according to the first aspect of the present invention, each gate of the plurality of MOS transistors may be formed by polycrystalline silicon or polycrystalline $Si_xGe_{1-x}$ (x: an integer number).

As a second aspect of the present invention, there is provided a reference voltage source circuit, which comprises a first MOS transistor and a second MOS transistor having gates of the same conduction type but of different impurity concentrations, and the difference between a work function of the first MOS transistor and a work function of the second MOS transistor is obtained as the reference voltage.

In the circuit according to the second aspect of the present invention, the drain current of the first MOS transistor and the drain current of the second MOS transistor may be made equal.

Further, in the circuit according to the second aspect of the present invention, gates of the first MOS transistor and the second MOS transistor may be formed by polycrystalline silicon or polycrystalline $Si_xGe_{1-x}$.

As a third aspect of the present invention, there is provided a reference voltage source circuit, which comprises a first MOS transistor and a second MOS transistor having gates of different impurity concentrations and also having equal temperature characteristics in the threshold voltage, and the difference between a gate-source voltage of the first MOS transistor and a gate-source voltage of the second MOS transistor is obtained as the reference voltage.

Further, in the circuit according to the third aspect of the present invention, the gate of the first MOS transistor and the gate of the second MOS transistor may be connected together, and the difference between a source voltage of the first MOS transistor and a source voltage of the second MOS transistor may be obtained as the reference voltage.

In addition, in the circuit according to the third aspect of the present invention, the first MOS transistor and the second MOS transistor may be connected in parallel, the source of the first MOS transistor may be connected to the ground, a circuit for making equal a current flowing through the first MOS transistor and a current flowing through the second MOS transistor may be provided, and the source voltage of the second MOS transistor may be obtained as the reference voltage.

Further, in the circuit according to the third aspect of the present invention, the first MOS transistor and the second MOS transistor may be connected in serial, the source of the first MOS transistor may be connected to the ground, and the source voltage of the second MOS transistor may be obtained as the reference voltage.

In addition, in the circuit according to the third aspect of the present invention, the source of the first MOS transistor and the source of the second MOS transistor may be connected together, and difference between gate voltage of the first MOS transistor and gate voltage of the second MOS transistor may be obtained as the reference voltage.

Further, in the circuit according to the third aspect of the present invention, the first MOS transistor and the second MOS transistor may be connected in parallel, a circuit for making equal a current flowing through the first MOS transistor and a current flowing through the second MOS transistor may be provided, the gate of the second MOS transistor may be connected to the ground, a resistor may be connected between the gate and the source of the first MOS transistor, and the gate voltage of the first MOS transistor may be obtained as the reference voltage.

In addition, in the circuit according to the third aspect of the present invention, the resistor may comprise a plurality of resistors so as to be used as a voltage divider and accordingly, an arbitrary voltage may be obtained therefrom as the reference voltage.

Further, in the circuit according to the third aspect of the present invention, the circuit may further comprise a configuration enabling to adjust a resistance value of the plurality of resistors after the manufacturing.

In addition, in the circuit according to the third aspect of the present invention, the gate and the source of one of the first MOS transistor and the second MOS transistor may be connected together, and voltage between the gate and the source of the other one of the first MOS transistor and the second MOS transistor may be obtained as the reference voltage.

Further, in the circuit according to the third aspect of the present invention, the source of the second MOS transistor, which source is connected to the gate of the second MOS transistor, may be further connected to a drain of the first MOS transistor, a third n-channel MOS transistor may be provided having a drain connected to the drain of the second MOS transistor, a gate to the source of the second MOS transistor, and a source to the gate of the first MOS transistor, a resistor may be connected between the gate and the source of the first MOS transistor, and the gate voltage of the first MOS transistor may be obtained as the reference voltage.

In addition, in the circuit according to the third aspect of the present invention, the resistor may comprise a plurality of resistors so as to be used as a voltage divider and accordingly, an arbitrary voltage may be obtained therefrom as the reference voltage.

Further, in the circuit according to the third aspect of the present invention, the circuit may further comprise a configuration enabling to adjust a resistance value of the plurality of resistors after the manufacturing.

In addition, in the circuit according to the third aspect of the present invention, the first MOS transistor and the second MOS transistor may comprise p-channel MOS transistors.

Further, in the circuit according to the third aspect of the present invention, the drain current of the first MOS transistor and the drain current of the second MOS transistor are may be made equal.

Finally, in the circuit according to the third aspect of the present invention, gates of the first MOS transistor and the second MOS transistor may be formed by polycrystalline silicon or polycrystalline $Si_xGe_{1-x}$.

Accordingly, the circuit according to the first, the second, and the third aspects of the present invention can operate with a low voltage and further it can operate stably with temperatures above 80 degrees Celsius. Also, since the circuit according to the present invention enables the transistors to be used not only in the weak inversion region but also in the strong inversion region, it can be dispensed with a minute current bias circuit. Or, it can be dispensed with a current bias circuit, which adjusts the temperature characteristic of the conductivity of the transistors.

Further, when the gates of two transistors are connected together, the difference of voltages between the gate and source of the two transistors can be obtained as the difference of the source voltages, and the difference of the source voltages can be obtained as the reference voltage. When the sources of two transistors are connected together, the difference of voltages between the gate and the source of the two transistors can be obtained as the difference of the gate voltages, and the difference of the gate voltages can be obtained as the reference voltage. When the gate and the source of one of the transistors are connected together, the difference of the voltages between the gate and the source of the two transistors can be obtained as the voltage between the gate and the source of the other one of the two transistors, and the voltage between the gate and the source of the other one of the two transistors can be obtained as the reference voltage.

Accordingly, it is possible to provide a reference voltage source circuit according to the present invention with various circuit configurations. Therefore, there is more freedom when manufacturing.

Accordingly, since the resistor, which is connected to a portion of the circuit for providing the reference voltage, can be made from a plurality of resistors, it is possible to obtain the reference voltage at an arbitrary level.

Accordingly, since the member adjusting the resistor value of the resistors after the manufacturing is provided, it is possible to change the level of the reference voltage after completion of the circuits.

DETAILED DESCRIPTION OF THE PREFERRED EMBODIMENTS

Figure 1:
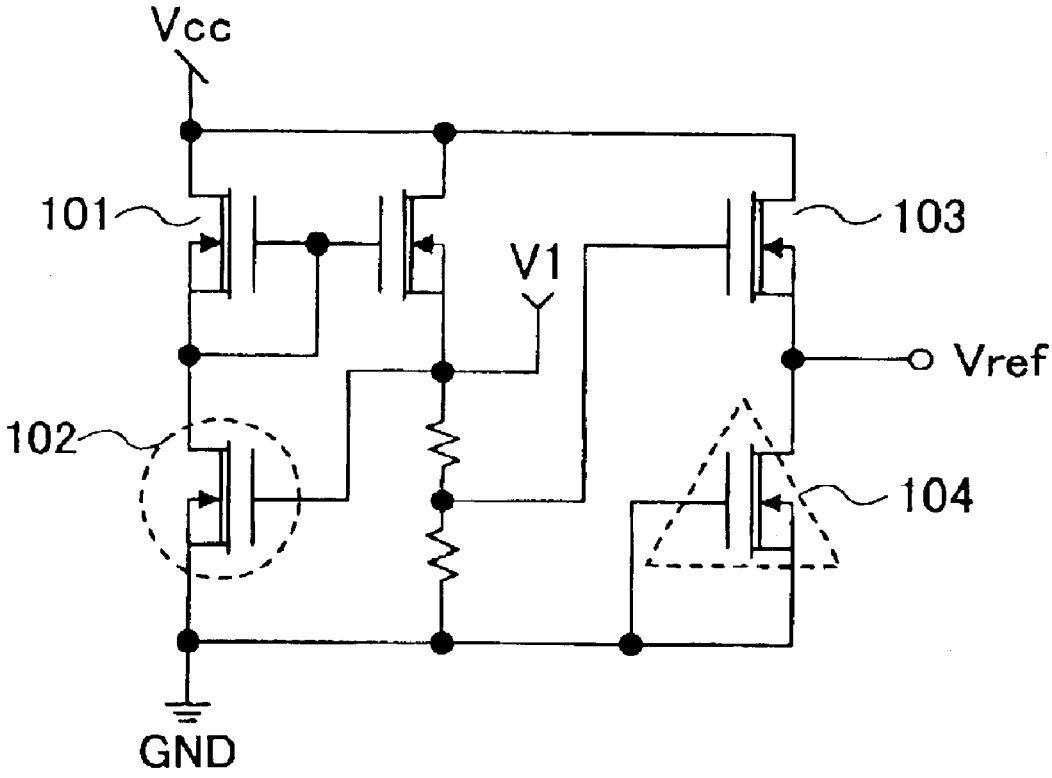
FIG. 1 is a diagram illustrating a reference voltage source circuit disclosed in citation 2.

The present invention is to realize, by a CMOS process, a reference voltage source circuit that operates with a low voltage and that can be used even in a strong inversion region, by using a pair of MOS transistors having gates of the same conduction type but of different impurity concentrations. Before going into the details of embodiments according to the present invention, the principle of the present invention is described below.

The threshold voltage Vt for causing a strong inversion state in a MOS transistor is expressed as:

$$Vt=\phi ms-Qf/\mathrm{Cox}+2\phi f-Qb/\mathrm{Cox} \quad (1)$$

where ϕms is the difference between the work function ϕm of the gate and the work function ϕs of the substrate, Qf is the fixed charge in the oxide film, ϕf is the Fermi level of the substrate, Qb is the charge in the depletion layer between the inversion layer and the substrate, and Cox is the capacitance per unit area of the oxide film.

Further, the work function ϕm has the following relation:

$$\phi m=x+Eg/2\pm\phi f \quad (2)$$

where the sign of the third term ϕf of the work function ϕm is positive when the gate is a P-type and is negative when the gate is an N-type. The difference in threshold voltage Vt of the pair of transistors having gates of the same conduction type but of different impurity concentrations (i.e. low impurity concentration (Ng1) and high impurity concentration (Ng2)) is equal to the difference in the work functions ϕm of gate material and further to the difference in Fermi level ϕf. When carrier concentration is equal to the impurity concentration, the following equation (3) can be obtained:

$$\begin{aligned} Vt1-Vt2 &= \phi m(Ng1)-\phi m(Ng2) \quad (3)\\ &= [Eg1/2-\phi f(Ng1)]-[Eg1/2-\phi f(Ng1)]\\ &= \phi f(Ng2)-\phi f(Ng1)\\ &= -kT/q\cdot\ln(Ng1/Ni)+kT/q\cdot\ln(Ng2/Ni)\\ &= kT/q\cdot\ln(Ng2/Ng1) \end{aligned}$$

where k is a Boltzmann constant, q is an amount of electrical charge of electrons, T is absolute temperature, Eg is a band gap of silicon, and Ni is the carrier concentration of the intrinsic semiconductor.

In the following, the temperature characteristic of Vt1−Vt2=Δt will be examined. When the gate is configured from a single crystal, polycrystalline silicon that has dangling bonds sufficiently terminated, or polycrystalline $Si_xGe_{x-1}$, the temperature variation (temperature characteristic) of the different impurity concentrations (Ng2, Ng1) is very small. Therefore, the temperature characteristic of the reference (output) voltage Vref becomes the voltage Proportional-To-Absolute-Temperature (PTAT) (equation (4)):

$$dVref/dT=(k/q)\ln(Ng2/Ng1) \quad (4)$$

Figure 2A:
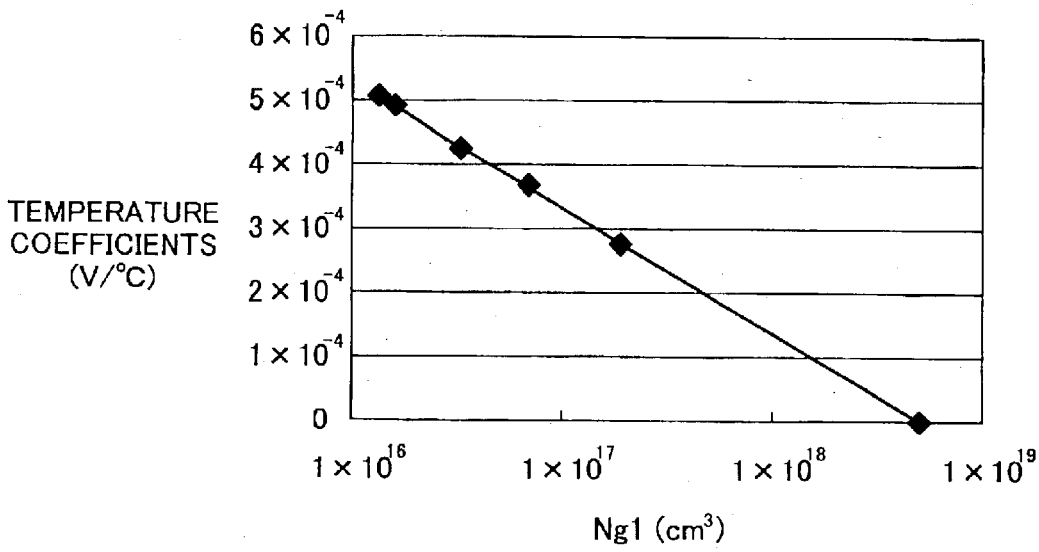
FIG. 2A is a graphic representation illustrating a relation of temperature coefficients with respect to low concentration (Ng1)
Figure 2B:
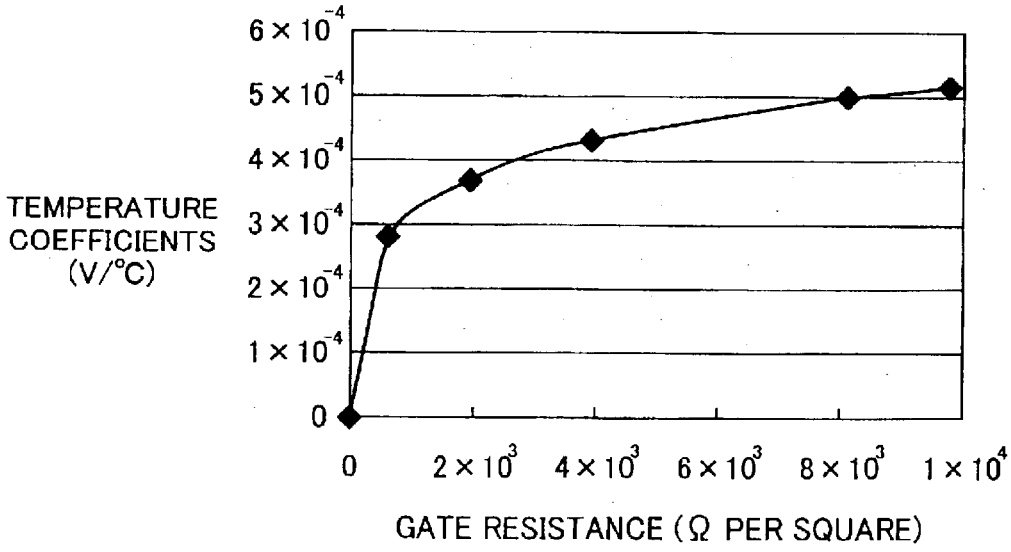
FIG. 2B is a graphic representation illustrating a relation of temperature coefficients with respect to gate resistance.

FIG. 2A and FIG. 2B are graphic representations based on the equation (4), where high concentration Ng2 is $5\times10^{18}$ $cm^3$. In FIG. 2A, the horizontal axis represents low concentration Ng1 and in FIG. 2B, the horizontal axis represents gate resistance, which is converted from low concentration Ng1 using the equation $\rho=1/(Ng1\cdot q\mu)$. As can be seen from FIG. 2B, there is a characteristic that as the value of gate resistance increases, the temperature coefficient also increases.

According to the present invention, as opposed to the related art, the gate is configured from polycrystalline silicon that has dangling bonds not sufficiently terminated or polycrystalline $Si_xGe_{1-x}$. It is known that in such a case, the temperature characteristic of resistance of polycrystalline silicon is large. For example, the gate configured from such polycrystalline silicon exhibits a negative temperature characteristic of approximately −2,800 parts per million (ppm) when the gate resistance is 1K Ω per square and of approximately −5,500 ppm when the gate resistance is 10K Ω per square. This indicates that the low concentration Ng1 has the temperature characteristic. The low concentration Ng1 can be simply expressed as a function of temperature as below:

$$Ng1=f[(T)(Ng1_0)] \quad (5)$$

Since a temperature component is included when calculating equation (3), an equation differentiated from the equation (3) by temperature cannot be simply expressed as the equation (4).

Figure 3:
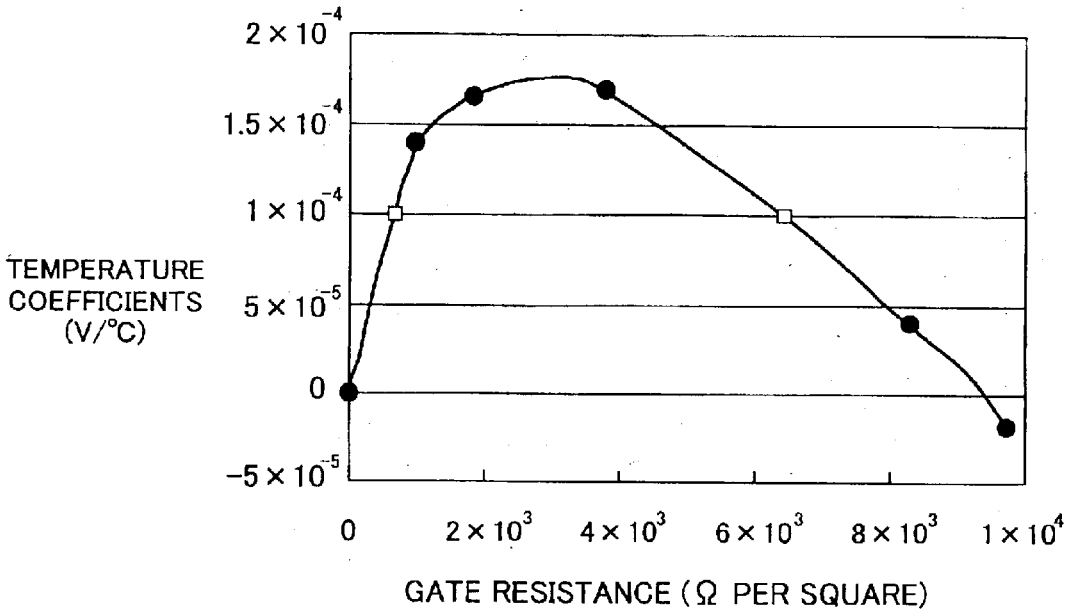
FIG. 3 is a graphic representation illustrating a relation of temperature coefficients with respect to gate resistance according to the present invention.

FIG. 3 shows result measured from an embodiment according to the present invention. FIG. 3 shows the measured temperature characteristics of the difference of the threshold voltages Vt using general N-channel field effect transistors having gate width/gate length=50 μm/100 μm and gate oxide film thickness=300 Å (angstroms). The measurement is performed between one such transistor having the highest impurity concentration (30 Ω per square, above which it is considered as being degenerated), and another such transistor whose condition of impurity concentration of the polycrystalline silicon gate is changed.

When compared with FIG. 2B, the same temperature characteristic (temperature coefficient) variation can be seen up to $2\times10^3$ Ω per square of gate resistance. However, when the gate resistance increases further, the temperature characteristic drops drastically. This indicates that after the gate resistance reaches the value of $2\times10^3$ Ω per square, the temperature characteristic of the impurity concentration in the polycrystalline silicon becomes the main factor for determining the temperature characteristic of the reference (output) voltage Vref. The temperature characteristic of the reference voltage Vref becomes 0 when the gate resistance value is approximately 9K Ω per square. After reaching the point where the temperature characteristic of the reference voltage Vref is 0, the temperature characteristic of the reference voltage Vref turns negative when the value of the gate resistance becomes larger (the impurity concentration becomes low).

Accordingly, by canceling out both temperature coefficients by using two transistors having the same temperature coefficient but different gate resistances, it is possible to obtain reference (output) voltage Vref without temperature coefficient. Accordingly, since Δt(=Vt1−Vt2 ) has no temperature characteristic, the following equation (6) can be obtained. As can be seen from the equation (6), the reference voltage Vref, which can be determined solely from the ratio of impurity concentrations of gates, can be obtained.

$$Vref=Vt1-Vt2=(kT/q)\ln(Ng2/Ng1) \quad (6)$$

Figure 4:
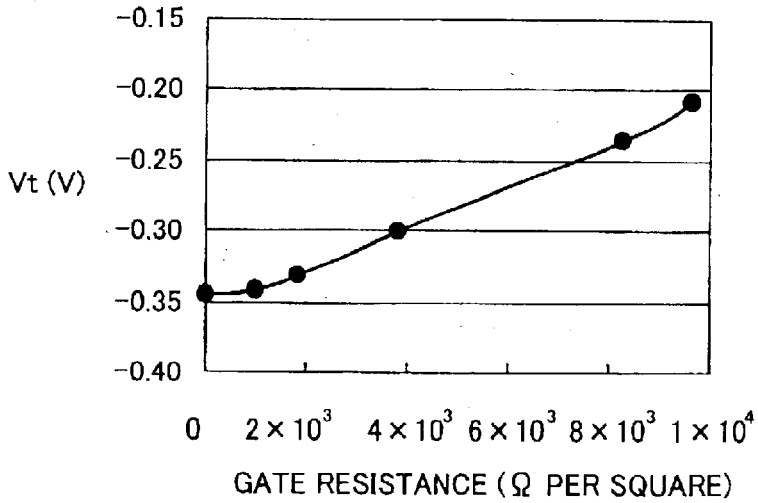
FIG. 4 is a graphic representation illustrating a relation of threshold voltage Vt with respect to gate resistance.

FIG. 4 shows the relation of the threshold voltage Vt with respect to the gate resistance. For example, in order to obtain reference voltage Vref so that its temperature characteristic is 0, it is understood from the forgoing examination that the transistor having 30 Ω per square of gate resistance and the transistor having 9K Ω per square of gate resistance may be combined.

When reading out the threshold voltages Vt of the transistors in such a case from FIG. 4, the threshold voltage Vt1 (9K Ω per square) is −0.23 V, the threshold voltage Vt2 (30 Ω per square) is −0.34 V, and the reference voltage Vref is Vt1−Vt2=0.11 V. Since the value of the reference voltage is sufficiently below 1 V, it is advantageous when generating a low reference voltage Vref in battery driven systems.

The present invention is characterized in that, as described with reference to FIG. 3 and FIG. 4, the difference of Fermi levels ϕf (the difference of subthreshold voltages Vt) between the transistor having gate resistance of 30 Ω per square and the transistor having gate resistance of 9K Ω per square, for example, is obtained as the reference voltage Vref. Specific embodiments according to the present invention are described below with reference to FIG. 5 through FIG. 15.

The following is a description of the processing method of the transistors according to the present invention.

In order to obtain gates with different phosphorous concentrations, first, a non-doped gate is deposited on a substrate. Then, the portions that are desired to be low concentration are masked with an oxide film. Phosphorous is deposited on the portions other than the masked portions so that the relevant portions become highly doped. The portions masked with the oxide film are lowly doped with phosphorous by ion implantation, after being etched. The portions to be highly doped can also be formed by ion implantation. Accordingly, it is possible to obtain a pair of transistors having gates of the same conduction type but of different Fermi levels ϕf. Since the process other than doping the gates is performed similarly, the respective transistors of the pair of transistors have the same insulating film thickness, the same channel doping, the same channel length, and the same channel width. Since only the impurity concentration differs, as mentioned above, the difference of the threshold voltage Vt is the difference of Fermi levels ϕf of the gates.

The following is a description of the method of obtaining the difference of Fermi levels ϕf of the gates.

The drain current Id of a MOS transistor in the saturation range (Vds>Vgs−Vt) is expressed as:

$$Id=(\beta/2)(Vgs-Vt)^2$$

where Vds is the voltage between drain and source, and Vgs is the voltage between gate and source.

Accordingly, the drain currents Id1, Id2 of the pair of MOS transistors M1, M2 having different gate concentrations are expressed as follows:

$$Id1=(\beta1/2)(Vgs1-Vt1)^2$$

$$Id2=(\beta2/2)(Vgs2-Vt2)^2$$

where Vgs1 and Vgs2 are the gate-source voltages, and Vt1 and Vt2 are the threshold voltages of respective MOS transistors M1, M2. Also, β1 and β2 are the conductivities of respective MOS transistors M1, M2. The conductivity β can be expressed as follow:

$$\beta=\mu(\epsilon OX/TOX)(Weff/Leff)$$

where $\mu$ is the carrier mobility, εOX is the dielectric constant of the oxide film, TOX is the oxide film thickness, Weff is the effective channel width, and Leff is the effective channel length.

Since each MOS transistor has the same carrier mobility $\mu$, the same dielectric constant of oxide film εOX, the same oxide film thickness TOX, the same effective channel width Weff, and the same effective channel length Leff, the conductivity β1 will be equal to the conductivity β2. When assuming Id1=Id2, the term (B/2) is cancelled out, and the following relation can be obtained:

$$(Vgs1-Vt1)^2=(Vgs2-Vt2)^2$$

By appropriately biasing the voltage between gate and source (Vgs), the difference of the threshold voltages (Vt2−Vt1) can be obtained from the difference of the gate-source voltages (Vgs1−Vgs2), and this in turn becomes the difference of Fermi levels φf.

The following is a description of embodiments of particular circuit configurations for obtaining the difference of the threshold voltages Vt, i.e. the difference of Fermi levels φf, in the pair of MOS transistors where only the impurity concentration of gates is different, with reference to the figures. Those embodiments of particular circuit configurations are given as particular examples of the reference voltage source circuit according to the present invention. In the following figures, a MOS transistor M1 enclosed by a dotted triangle represents a MOS transistor with an n-type polysilicon gate with low concentration (Ng1).

A MOS transistor M2 represents a MOS transistor with an n-type polysilicon gate with high concentration (Ng2). More specifically, the impurity concentrations (Ng1, Ng2) are controlled so that the gate resistance of the transistor M1 is approximately 30 Ω per square and the gate resistance of the transistor M2 is approximately 9K Ω per square so that the temperature characteristic of the reference voltage Vref is 0. In the following circuit configuration examples, the transistors M1, M2 have the same insulating film thickness, the same channel doping, the same channel length, and the same channel width (therefore, their conductivity β is the same), and only the impurity concentration differs.

According to a first embodiment of the present invention, descriptions will be given to circuit configuration examples, in which gates of the MOS transistors M1, M2 are connected together to one another. In such configuration examples, since the gate potentials of both transistors are equal, "the difference of voltages between gates and sources" is equal to "the difference of source voltages" of both transistors. The difference of the source voltages is obtained as the reference (output) voltage Vref.

Figure 5:
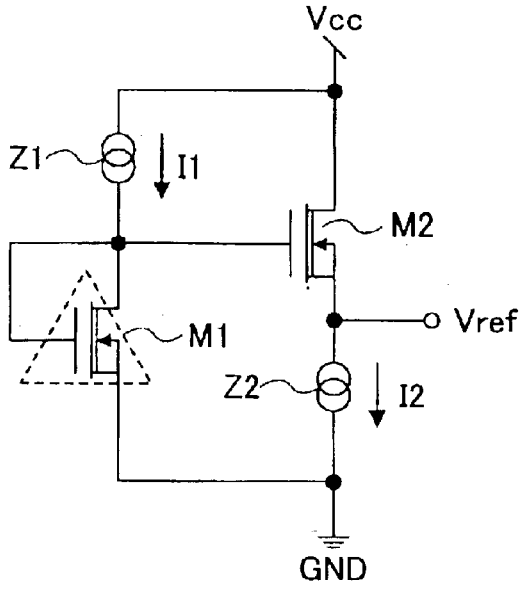
FIG. 5 shows a first circuit configuration example of a first embodiment according to the present invention.

FIG. 5 shows a first circuit configuration example of the first embodiment according to the present invention. The MOS transistor M1 and the MOS transistor M2 are connected in parallel. According to the first circuit configuration example, a constant current circuit Z1 and the MOS transistor M1 having an n-type polysilicon gate with low concentration (Ng1), which are serially connected, and the MOS transistor M2 having an n-type polysilicon gate with high concentration (Ng2) and a constant current circuit Z2, which are serially connected, are inserted between the power supply Vcc and the ground GND. In addition, the gates of the transistors are connected together.

By making the conductivity β of both MOS transistors M1, M2 the same and by inserting the constant current circuits Z1, Z2, the currents between the drain and the source of respective transistors become equal (I1=I2). As for the constant current circuits, transistors may be used, for example, in the current saturation region or current mirror circuits as described in the figures below may be added.

According to the first circuit configuration example shown in FIG. 5, since "the difference of voltages between gates and sources" is equal to "the difference in source voltages" (because the gate potentials are equal), and since the source potential of the MOS transistor M1 is 0, "the difference of source voltages" is equal to "the source potential" of the MOS transistor M2. Accordingly, the source potential of the MOS transistor M2 corresponds to the difference Ut·ln(Ng2/Ng1) of Fermi level φf. The source potential of the transistor M2 can be obtained as the reference (output) voltage Vref.

The lowest necessary power supply voltage Vcc is equal to the sum of the reference voltage Vref and the voltage between the source and the drain of the MOS transistor M2. Since the reference voltage Vref is approximately 0.11 V, it is possible to keep the power supply voltage Vcc under 1 V.

Figure 6:
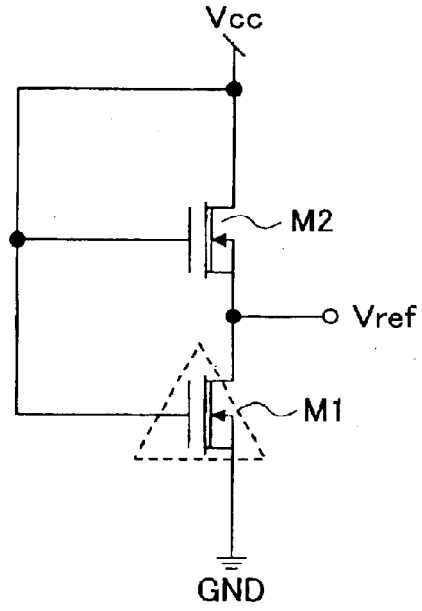
FIG. 6 shows a second circuit configuration example of the first embodiment according to the present invention.

FIG. 6 shows a second circuit configuration example of the first embodiment according to the present invention. The MOS transistor M1 and the MOS transistor M2 are connected in serial. The circuit configuration example shown in FIG. 6 is the basic circuit configuration. According to the second circuit configuration example, the MOS transistor M1 having an n-type polysilicon gate with low concentration (Ng1) and the MOS transistor M2 having an n-type polysilicon gate with high concentration (Ng2) are serially connected between the power supply Vcc and the ground GND. In addition, the gates of the transistors are commonly connected to the drain of the transistor M2.

In the second circuit configuration example, as in the first circuit configuration example shown in FIG. 5, since "the difference of voltages between gates and sources" is equal to "the difference in source voltages" (because the gate potentials are equal), and since the source potential of the MOS transistor M1 is 0, "the difference of source voltages" is equal to "the source potential" of the MOS transistor M2. Accordingly, the source potential of the transistor M2 can be obtained as the reference voltage Vref.

According to a second embodiment of the present invention, descriptions will be given to circuit configuration examples, in which sources of the MOS transistors M1, M2 are connected together to one another. In such configuration examples, since source potentials of the transistors are equal, "the difference of voltages between gates and sources" is equal to "the difference of gate voltages" of the transistors. The difference of the gate voltages is obtained as the reference (output) voltage Vref.

Figure 7:
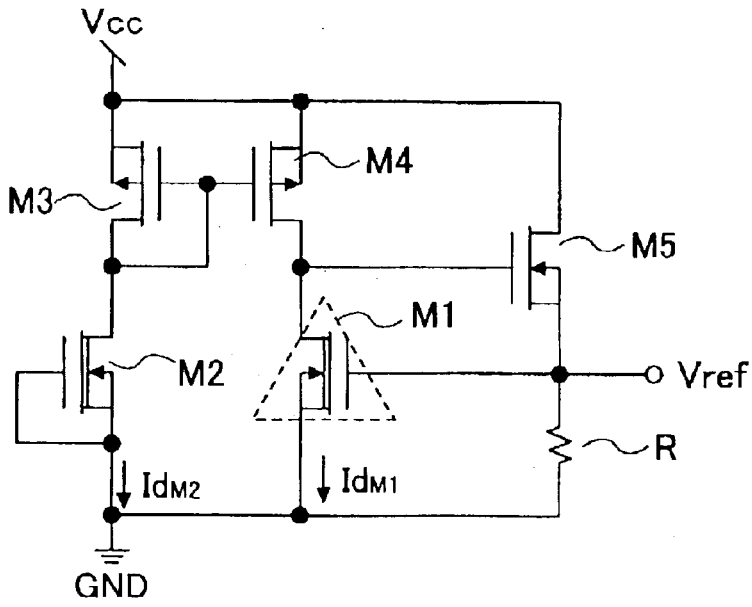
FIG. 7 shows a first circuit configuration example of a second embodiment according to the present invention.

FIG. 7 shows a first circuit configuration example of the second embodiment according the present invention. The circuit configuration example shown in FIG. 7 is the basic circuit configuration. As shown in FIG. 7, a p-channel MOS transistor M3 and the MOS transistor M2 are serially connected between the power supply Vcc and the ground GND. Also, a p-channel MOS transistor M4 and the MOS transistor M1 are serially connected between the power supply Vcc and the ground GND. The transistor M3 and the transistor M4 configure a current mirror circuit. The transistor M2 is a depletion type, which has its gate connected to its source (i.e. the voltage between gate and source Vgs is 0). In addition, an n-type MOS transistor M5, which is the source follower, having its drain connected to the power supply Vcc, its gate to the drain of the transistor M1, and its source to the gate of the transistor M1, is provided. The gate of the transistor M1 is connected to the ground GND through a resistor R.

By means of the current mirror function of the transistor M3 and the transistor M4, the constant current the same as that applied to the transistor M2 is applied to the transistor M1. The transistor M5 biases the gate of the transistor M1 so as to make the drain current $Id_{M1}$ equal to the drain current $Id_{M2}$.

In such a circuit configuration, since "the difference of voltages between gates and sources" is equal to "the difference of gate voltages" (because the source potentials are equal), and since the gate potential of the transistor M2 is 0, "the difference of gate voltages" is equal to "the gate potential" of the transistor M1. Accordingly, the source potential of the transistor M1 can be obtained as the reference voltage Vref. In such a circuit configuration, the lowest necessary power supply voltage Vcc is the sum of the reference voltage Vref, the voltage between the source and the gate of the transistor M5, and the voltage between the source and the drain of the transistor M4. Since the reference voltage Vref is 0.11 V, it is possible to keep the power supply voltage Vcc under 1 V.

In addition, in such a circuit configuration, since the voltage between the gate and the source of the transistor M2 is 0, "the difference of voltages between gates and sources" is equal to "the difference of voltage between gate and source" of the transistor M1. Further, since the source voltage of the transistor M1 is 0, "the voltage between gate and source" of the transistor M1 is equal to "the gate voltage" of the transistor M1. Accordingly, the gate voltage of the transistor M1 can be obtained as the reference voltage Vref.

Figure 8:
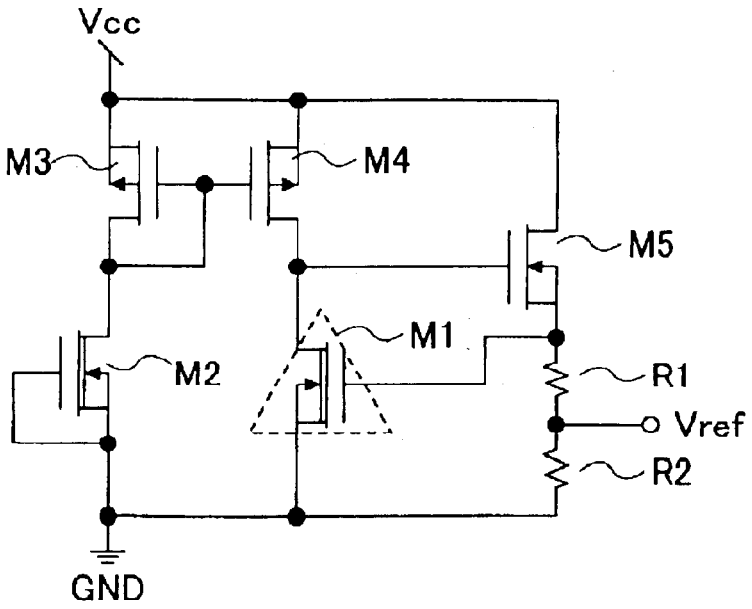
FIG. 8 shows a second circuit configuration example of the second embodiment according to the present invention.

FIG. 8 shows a second circuit configuration example of the second embodiment according to the present invention. The second circuit configuration example can be obtained as a modification example of the first circuit configuration example shown in FIG. 7. The second circuit configuration example has the same configuration as that of the first circuit configuration example shown in FIG. 7 except for the resistor R provided between the gate of the transistor M1 and the ground GND in FIG. 7 is divided into two resistors R1 and R2. The reference voltage Vref is obtained from the, connection point between the resistor R1 and the resistor R2. In such a circuit configuration, the reference (output) voltage Vref can be expressed as follows:

$$Vref=(R2/(R1+R2))U_T\cdot\ln(Ng2/Ng1)$$

The lowest necessary power supply voltage Vcc in such a circuit configuration is the sum of the gate voltage of the transistor M1, the voltage between the source and the gate of the transistor M5, and the voltage between the source and the drain of the transistor M4. Since the gate voltage of the transistor M1 is 0.11 V, it is possible to keep the power supply voltage Vcc under 1 V.

Figure 9:
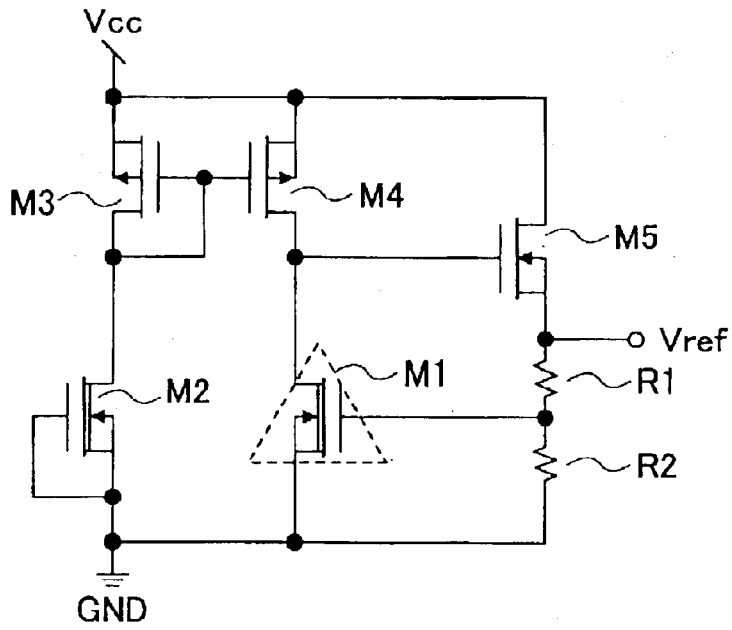
FIG. 9 shows a third circuit configuration example of the second embodiment according to the present invention.

FIG. 9 shows a third circuit configuration example of the second embodiment according to the present invention. The third circuit configuration example can be obtained as a modification example of the first circuit configuration example shown in FIG. 7. The third circuit configuration example has the same configuration as that of the second circuit configuration example shown in FIG. 8 except that the gate of the transistor M1 is connected to the connection point between the resistor R1 and the resistor R2, and the reference voltage Vref is obtained from the connection point between the source of the transistor M5 and the resistor R1. In such a circuit configuration, the reference (output) voltage Vref can be expressed as follows:

$$Vref=((R1+R2)/R2)U_T\cdot\ln(Ng2/Ng1)$$

The lowest necessary power supply voltage Vcc in such a circuit configuration is the sum of the reference voltage Vref, the voltage between the source and the gate of the transistor M5, and the voltage between the source and the drain of the transistor M4. The reference voltage Vref changes depending on the ratio of (R1+R2)/R2, which in turn determines the lowest necessary power supply voltage Vcc.

Figure 10:
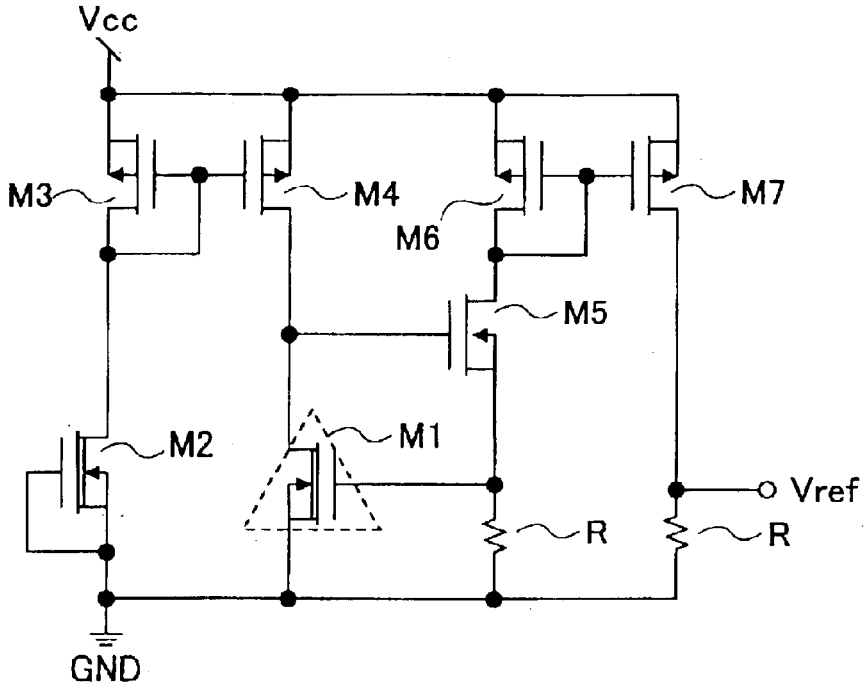
FIG. 10 shows a fourth circuit configuration example of the second embodiment according to the present invention.

FIG. 10 shows a fourth circuit configuration example of the second embodiment according to the present invention. The fourth circuit configuration example can be obtained as a modification example of the first circuit configuration example shown in FIG. 7. The fourth circuit configuration example has the same configuration as that of the first circuit configuration example shown in FIG. 7 except that an additional current mirror circuit, which is configured from a p-channel MOS transistor M6 and a p-channel MOS transistor M7, is provided on the current path to the resistor R between the gate and the source of the first transistor M1 shown in FIG. 7. The reference voltage Vref is obtained from the source of the transistor M7. In such a circuit configuration, the reference voltage Vref can be expressed as follows:

$$Vref=M\cdot U_T\cdot\ln(Ng2/Ng1)$$

where M is the ratio of the current mirror function. The lowest necessary power supply voltage Vcc in such a circuit configuration is the sum of the gate voltage of the transistor M1, the voltage between the source and the gate of the transistor M5, and the voltage between the source and the drain of the transistor M4. Since the gate voltage of the transistor M1 is 0.11 V, it is possible to keep the power supply voltage Vcc under 1 V.

In the second, the third, and the fourth circuit configuration examples according to the second embodiment of the present invention shown in FIG. 8, FIG. 9, and FIG. 10, respectively, it is possible to obtain the reference (output) voltage Vref, which is the result from multiplying the reference (output) voltage $U_T\cdot\ln(Ng2/Ng1)$ of the first circuit configuration example shown in FIG. 7 by the resistance ratio or the current ratio (ratio M of the current mirror function). Therefore, changing the resistance ratio or the current ratio can arbitrarily adjust the value of the reference voltage Vref.

Figure 11:
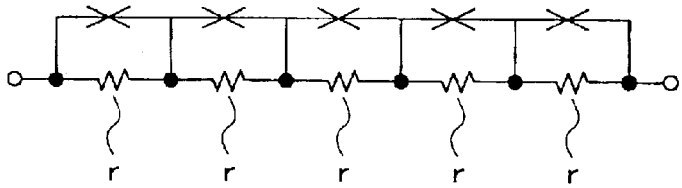
FIG. 11 is a diagram schematically illustrating a series circuit with serially connected resistors, onto which trimming can be performed.

Further, in order to adjust the reference voltage Vref with high precision, it is possible to adjust the ratio of the resistance values of the resistors R1, R2, after diffusion and film forming processes, by a using trimming member (a resistance value adjusting member). The trimming member trims the resistors by selectively irradiating laser beams thereon. FIG. 11 shows one example for such trimming member. FIG. 11 shows a series circuit having serially connected resistors R. By burning off any number of shunt portions indicated by X with the laser beam, it is possible to obtain a desired resistance value (a multiple of resistance value r). Therefore, by using such a member, it is possible to adjust the resistance value of the resistors R1, R2.

According to a third embodiment of the present invention, descriptions will be given to circuit configuration examples, in which the MOS transistor M2 of a depletion type having its gate connected to its source (i.e. the voltage between gate and source (Vgs) is 0) and the MOS transistor M1 applied with the same current as that applied to the transistor M2. In such circuit configuration examples, since the voltage between the gate and the source of the transistor M2 is 0, "the difference of voltages between gates and sources" between the transistor M1 and the transistor M2 is equal to "the difference of voltage between gate and source" of the transistor M1.

Figure 12:
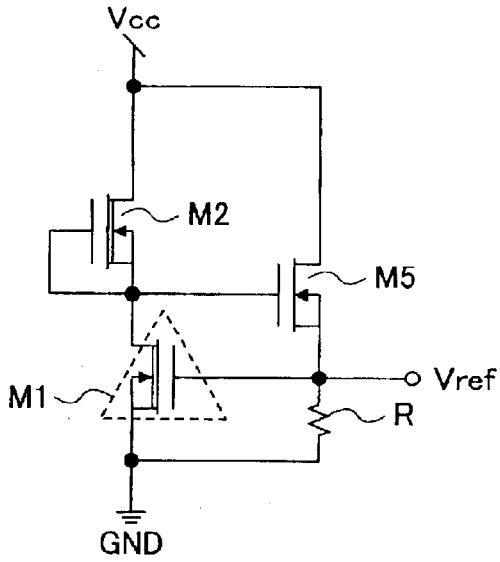
FIG. 12 shows a first circuit configuration example of a third embodiment according to the present invention.

FIG. 12 shows a first circuit configuration example of the third embodiment according to the present invention. The first circuit configuration example shown in FIG. 12 is a basic circuit configuration. As shown in FIG. 12, the depletion type (i.e. the voltage between the gate and the drain is 0) transistor M2 having the n-type polysilicon gate with high concentration (Ng2) and the depletion type transistor M1 having the n-type polysilicon gate with low concentration (Ng1) are serially connected between the power supply Vcc and the ground GND.

In addition, an n-channel MOS transistor M5 is provided. The drain of the transistor M5 is connected to the drain (=power supply Vcc) of the transistor M2, its gate to the source of the transistor M2, and its source to the gate of the transistor M1. The gate of the transistor M1 is connected to the ground GND (source) via a resistor R. In such a circuit configuration, as mentioned above, the voltage between the gate and the source of the transistor M1 is obtained as the reference (output) voltage Vref.

The lowest necessary power supply voltage Vcc in such a circuit configuration is the sum of the reference voltage Vref, the voltage between the source and the gate of the transistor M5, and the voltage between the source and the gate of the transistor M1. Since the reference voltage Vref is 0.11 V, it is possible to keep the power supply voltage Vcc under 1 V.

Figure 13:
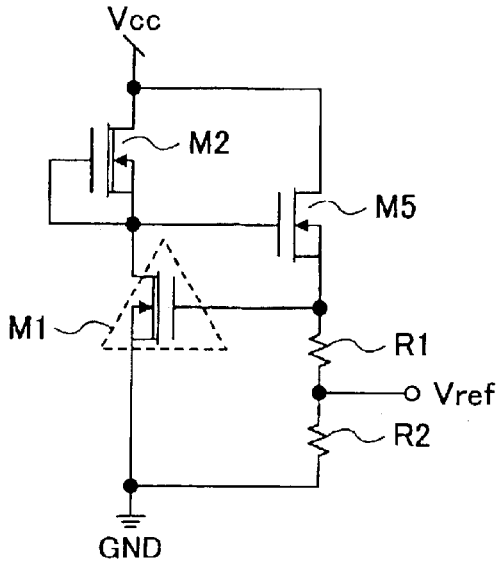
FIG. 13 shows a second circuit configuration example of the third embodiment according to the present invention.

FIG. 13 shows a second circuit configuration example of the third embodiment according to the present invention. The second circuit configuration example can be obtained as a modification example of the first circuit configuration example shown in FIG. 12. The second circuit configuration example has the same configuration as that of the first circuit configuration example shown in FIG. 12 except for the resistor R, which is divided into two resistors R1, R2 between the gate of the transistor M1 and the ground GND. The reference voltage Vref is obtained from the connection point between the resistor R1 and the resistor R2. In such a circuit configuration, the reference voltage Vref can be expressed as follows:

$$Vref=(R2/(R1+R2))U_T\cdot\ln(Ng2/Ng1)$$

The lowest necessary power supply voltage Vcc in such a circuit configuration is the sum of the gate voltage of the transistor M1 and the voltage between the source and the drain of the transistor M5. Since the gate voltage of the transistor M1 is 0.11 V, it is possible to keep the power supply voltage Vcc under 1 V.

Figure 14:
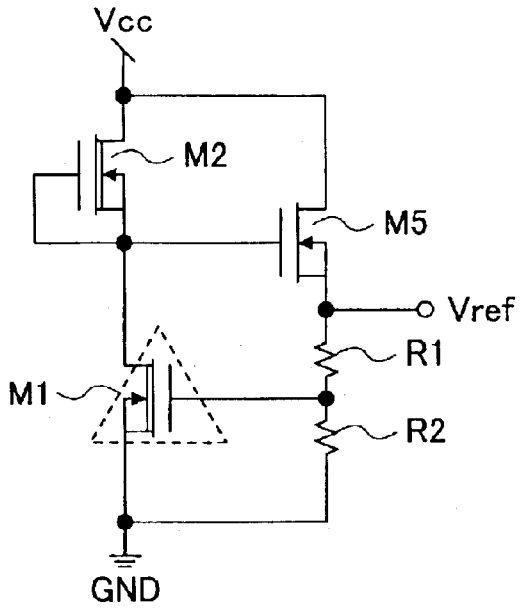
FIG. 14 shows a third circuit configuration example of the third embodiment according to the present invention.

FIG. 14 shows a third circuit configuration example of the third embodiment according to the present invention. The third circuit configuration example of the third embodiment can be obtained as a modification example of the first circuit configuration example shown in FIG. 12. The third circuit configuration example has the same configuration as that of the first circuit configuration example shown in FIG. 12 except for the resistor R provided between the gate of the first transistor M1 and the ground GND. The resistor R is denoted as R2 in FIG. 14 and an additional resistor R1 is inserted between the gate of the transistor M1 and the source of the transistor M5. The reference (output) voltage Vref is obtained from the source of the transistor M5. In such a circuit configuration, the reference voltage Vref can be expressed as follows:

$$Vref=((R1+R2)/R2)U_T\cdot\ln(Ng2/Ng1)$$

Figure 15:
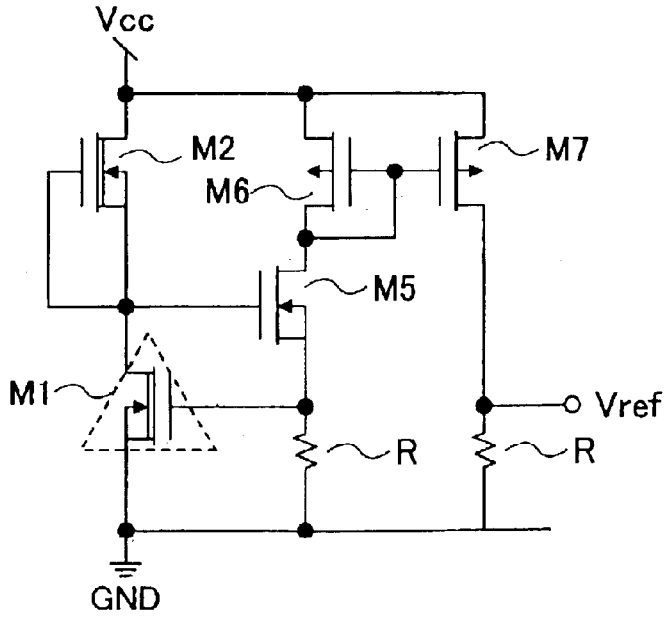
FIG. 15 shows a fourth circuit configuration example of the third embodiment according to the present invention.

FIG. 15 shows a fourth circuit configuration example of the third embodiment according to the present invention. The fourth circuit configuration example can be obtained as a modification example of the first circuit configuration example shown in FIG. 12. The fourth circuit configuration example of the third embodiment according to the present invention has the same configuration as that of the first circuit configuration example shown in FIG. 12 except that an additional current mirror circuit, which is configured from a p-channel MOS transistor M6 and a p-channel MOS transistor M7, is provided on the current path to the resistor R between the gate and the source of the transistor M1. The reference voltage Vref is obtained from the source of the transistor M7. In such a circuit configuration, the reference (output) voltage Vref can be expressed as follows:

$$Vref=M\cdot U_T\cdot\ln(Ng2/Ng1)$$

where M is the ratio of the current mirror function. The lowest necessary power supply voltage Vcc in such a circuit configuration is the sum of the reference voltage Vref and the voltage between the source and the drain of the transistor M7. Since the reference voltage Vref is 0.11 V, it is possible to keep the power supply voltage Vcc under 1 V.

In the second, the third, and the fourth circuit configuration examples of the third embodiment according to the present invention shown in FIG. 13, FIG. 14, and FIG. 15, respectively, it is possible to obtain the reference (output) voltage Vref, which is the result from multiplying the reference (output) voltage $U_T\cdot\ln(Ng2/Ng1)$ of the first circuit configuration example shown in FIG. 12 by the resistance ratio or the current ratio (ratio M of the current mirror function). Therefore, changing the resistance ratio or the current ratio can arbitrarily adjust the value of the reference voltage Vref.

Further, in order to adjust the reference voltage Vref with high precision, it is possible to adjust the ratio of the resistance values of the resistors R1, R2, after diffusion and film forming processes, by using a trimming member (a resistance value adjusting member). The trimming member trims the resistors by selectively irradiating laser beams thereon as described with respect to FIG. 11.

In the circuit configuration examples of the third embodiment according to the present invention, the lowest necessary power supply voltage Vcc is the sum of the reference voltage Vref, the voltage between the source and the drain of the transistor M5, and the voltage between source and gate of the transistor M2. The reference voltage Vref changes depending on the value of (R1+R2)/R2, which in turn determines the lowest necessary power supply voltage Vcc.

According to a fourth embodiment of the present invention, a description will be given to a circuit configuration example, in which the MOS transistor M1 having the n-type polysilicon gate with low concentration (Ng1) and the second MOS transistor M2 having the n-type polysilicon gate with high concentration (Ng2) are provided. A voltage that corresponds to the difference of Fermi levels is applied to the transistor M1 and the transistor M2 as the gate voltage so as to have equal gate conductance.

Figure 16:
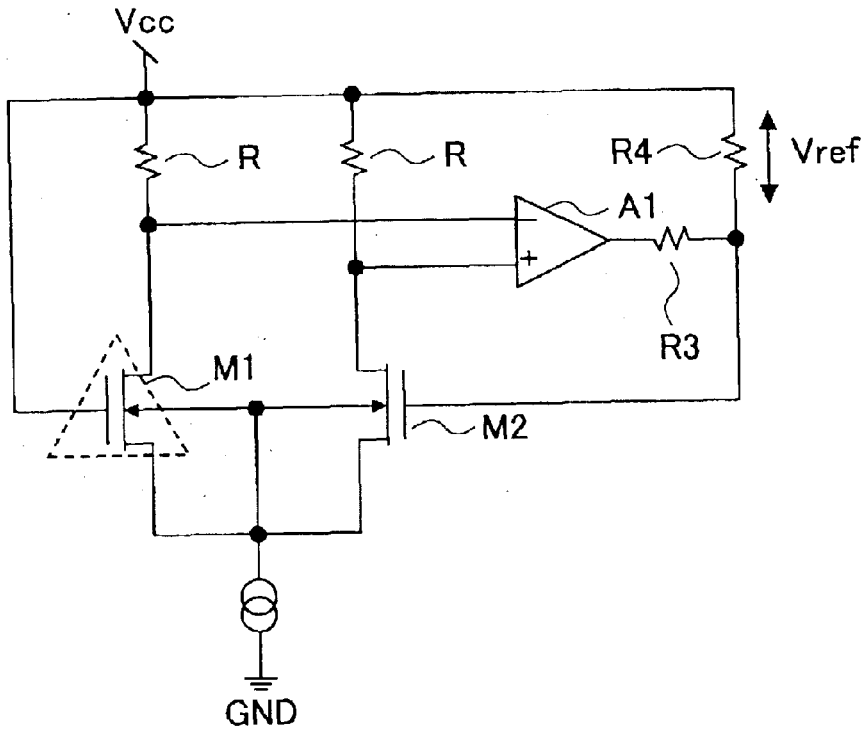
FIG. 16 shows a basic circuit configuration example of a fourth embodiment according to the present invention.

FIG. 16 shows a basic circuit configuration example of the fourth embodiment according to the present invention. As shown in FIG. 16, the transistor M1 and the transistor M2, which have their sources connected to each other, are connected in parallel by way of respective resistors R between the power supply Vcc and the ground GND. The potential of the drains of the transistors M1, M2 are provided to a differential amplifier A1 and the output from the differential amplifier A1 is fed back to the gate of the transistor M2 via a resistor R3. A resistor R4 is provided between the power supply Vcc and the gate of the transistor M2.

In such a circuit configuration, since the drain voltages of the transistors M1, M2 have the same potential (the differential input provided to the amplifier A1) and since the transistors M1, M2 have the same current (the resistors R are the same), the voltages between the gates and the sources of the respective transistors are equal to one another. In addition, since the sources of respective transistors are shared, "the difference of voltages between gates and sources" is "the difference of gate voltages". Further, since the gate of the transistor M1 and the gate of the transistor M2 are connected via the resistor R4, the difference of potential between both ends of the resistor 4 is "the difference of gate voltages", i.e. the reference voltage Vref.

Figure 17:
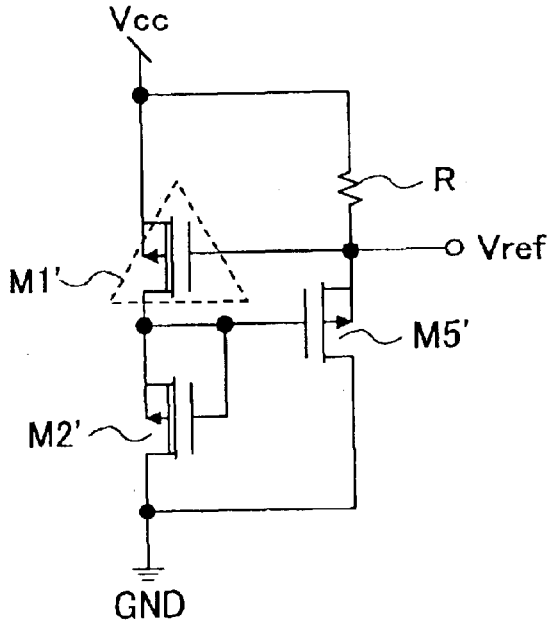
FIG. 17 shows a modification example of the first circuit configuration example of the third embodiment according to the present invention shown in FIG. 12.
Figure 18:
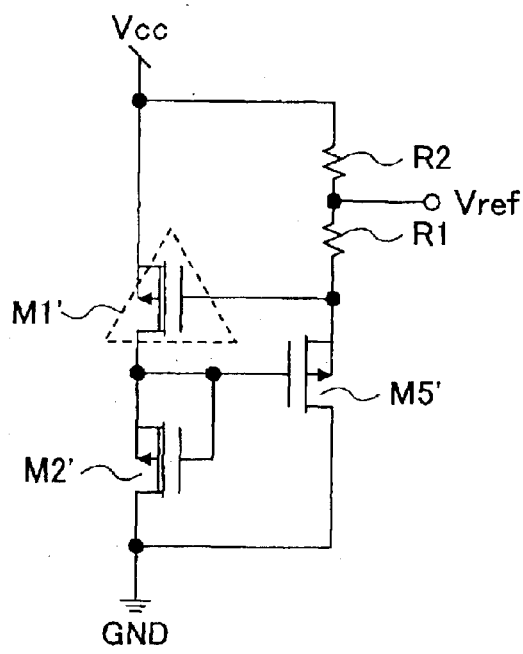
FIG. 18 shows a modification example of the second circuit configuration example of the third embodiment according to the present invention shown in FIG. 13.
Figure 19:
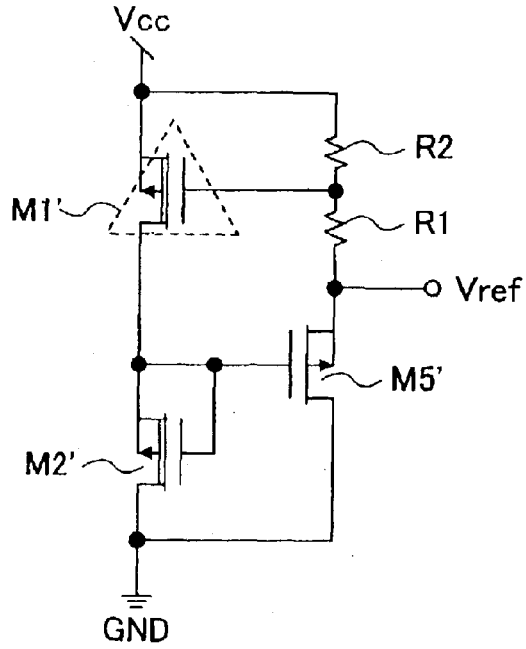
FIG. 19 shows a modification example of the third circuit configuration example of the third embodiment according to the present invention shown in FIG. 14.

According to the first embodiment through the fourth embodiment of the present invention, n-channel MOS transistors are used for transistors M1, M2. However, it is possible to realize similar circuits mentioned above using p-channel MOS transistors. In such a case, channel types (n channel/p channel) of each MOS transistor used in respective embodiments may be inverted, and the power supply voltage may be inverted between a high voltage side and a low voltage side. For example, with respect to the circuit configurations shown in FIG. 12 through FIG. 14, circuit configurations shown in FIG. 17 through FIG. 19 may be obtained, in which M1', M2', and M5' correspond to M1, M2, and M5, respectively.

Further, the present invention is not limited to these embodiments, and variations and modifications may be made without departing from the scope of the present invention.

The present application is based on Japanese priority application No. 2002-077912 filed on Mar. 20, 2002, the entire contents of which are hereby incorporated by reference.

What is claimed is:

1. A reference voltage source circuit comprising:

a plurality of MOS transistors having gates of the same conduction type but of different impurity concentrations and also having equal temperature characteristics in threshold voltage wherein said MOS transistors are configured such that said voltage reference circuit maintains stable operation at less than about 1 volt.

2. The circuit as claimed in claim 1, wherein:

each gate of said MOS transistors is formed by polycrystalline silicon or polycrystalline $Si_xGe_{1-x}$, where x denotes an integer number.

3. A reference voltage source circuit comprising:

a first MOS transistor and a second MOS transistor having gates of the same conduction type but of different impurity concentrations and also having equal temperature characteristics in threshold voltage; and the difference between a work function of said first MOS transistor and a work function of said second MOS transistor is obtained as a reference voltage.

4. The circuit as claimed in claim 3, wherein:

a drain current of said first MOS transistor and a drain current of said second MOS transistor are made equal.

5. The circuit as claimed in claim 4, wherein:

the gates of said first MOS transistor and said second MOS transistor are formed by polycrystalline silicon or polycrystalline $Si_xGe_{1-x}$, where x denotes an integer number.

6. A reference voltage source circuit comprising:

a first MOS transistor and a second MOS transistor having gates of different impurity concentrations and also having equal temperature characteristics in threshold voltage; and the difference between a voltage between a gate and a source of said first MOS transistor and a voltage between a gate and a source of said second MOS transistor is obtained as a reference voltage.

7. The circuit as claimed in claim 6, wherein:

the gate of said first MOS transistor and the gate of said second MOS transistor are connected together; and the difference between source voltage of said first MOS transistor and source voltage of said second MOS transistor is obtained as the reference voltage.

8. The circuit as claimed in claim 7, wherein:

said first MOS transistor and said second MOS transistor are connected in parallel;

the source of said first MOS transistor is connected to the ground;

a circuit for making equal a current flowing through said first MOS transistor and a current flowing through said second MOS transistor is provided; and the source voltage of said second MOS transistor is obtained as the reference voltage.

9. The circuit as claimed in claim 7, wherein:

said first MOS transistor and said second MOS transistor are connected in serial; the source of said first MOS transistor is connected to the ground; and the source voltage of said second MOS transistor is obtained as the reference voltage.

10. The circuit as claimed in claim 6, wherein:

the source of said first MOS transistor and the source of said second MOS transistor are connected together; and the difference between gate voltage of said first MOS transistor and gate voltage of said second MOS transistor is obtained as the reference voltage.

11. The circuit as claimed in claim 10, wherein:

said first MOS transistor and said second MOS transistors are connected in parallel;

a circuit for making equal a current flowing through said first MOS transistor and a current flowing through said second MOS transistor is provided;

the gate of said second MOS transistor is connected to the ground;

a resistor is connected between the gate and the source of said first MOS transistor; and the gate voltage of said first MOS transistor is obtained as the reference voltage.

12. The circuit as claimed in claim 11, wherein:

said resistor comprises a plurality of resistors so as to be used as a voltage divider and accordingly, an arbitrary voltage can be obtained therefrom as the reference voltage.

13. The circuit as claimed in claim 12, wherein:

said circuit further comprises a configuration enabling to adjust a resistance value of the plurality of resistors after the manufacturing.

14. The circuit as claimed in claim 6, wherein:

the gate and the source of one of said first MOS transistor and said second MOS transistor are connected together; and voltage between the gate and the source of the other one of said first MOS transistor and said second MOS transistor is obtained as the reference voltage.

15. The circuit as claimed in claim 14, wherein:

the source of said second MOS transistor, which source is connected to the gate of said second MOS transistor, is further connected to a drain of said first MOS transistor;

a third n-channel MOS transistor is provided having a drain connected to a drain of said second MOS transistor, a gate connected to the source of said second MOS transistor, and a source connected to the gate of said first MOS transistor;

a resistor is connected between the gate and the source of said first MOS transistor; and gate voltage of said first MOS transistor is obtained as the reference voltage.

16. The circuit as claimed in claim 15, wherein:

said resistor comprises a plurality of resistors so as to be used as voltage divider and accordingly, an arbitrary voltage can be obtained therefrom as the reference voltage.

17. The circuit as claimed in claim 16, wherein:

said circuit further comprises a configuration enabling to adjust a resistance value of the plurality of resistors after the manufacturing.

18. The circuit as claimed in claim 15, wherein:

said first MOS transistor and said second MOS transistor comprise p-type-channel MOS transistors.

19. The circuit as claimed in claim 6, wherein:

a drain current of said first MOS transistor and a drain current of said second MOS transistor are made equal.

20. The circuit as claimed in claim 6, wherein:

the gates of said first MOS transistor and said second MOS transistor are formed by polycrystalline silicon or polycrystaliine $Si_xGe_{1-x}$, where x denotes an integer number.

* * * * *